United States Patent [19]

Kubrak

[11] 4,129,110

[45] Dec. 12, 1978

[54] DEVICE FOR LAUNCHING AND RETRIEVING A SPHERICAL BALL

[76] Inventor: Ronald Kubrak, 7 Beechwood Ct., Hazlet, N.J. 07730

[21] Appl. No.: 757,443

[22] Filed: Jan. 6, 1977

[51] Int. Cl.[2] ..... F41B 7/00

[52] U.S. Cl. ..... 124/16; 124/41 R; 273/26 D; 273/95 A; 273/26 E

[58] Field of Search ..... 273/26 E, 26 B, 29 A, 273/95 A, 97 R, 200 R, 200 A, 26 D, 185 C, 185 D; 124/16, 17, 41 R, 37; 272/140

[56] References Cited

U.S. PATENT DOCUMENTS

| | | | |
|---|---|---|---|
| 3,050,305 | 8/1962 | Bachand et al. | 272/140 X |
| 3,376,037 | 4/1968 | Lepselter | 273/26 B |
| 3,545,752 | 12/1970 | Hill | 124/16 X |
| 3,612,027 | 10/1971 | Makino | 124/16 |
| 3,626,502 | 12/1971 | Well | 273/26 E |
| 3,841,294 | 10/1974 | McGill | 124/16 |
| 3,856,300 | 12/1974 | Payne | 124/16 X |

*Primary Examiner*—Richard C. Pinkham
*Assistant Examiner*—William R. Browne
*Attorney, Agent, or Firm*—Daniel Jay Tick

[57] ABSTRACT

A housing has an open-topped hemispherical recess in its top to accommodate a spherical ball. The ball is attached to one end of a cable which is itself secured to a spring loaded reel inside the housing. When ejector means are operated by the user's foot, the ball is ejected upwardly out of the recess, so as to enable the ball to be hit by a bat. As the ball travels after being hit, the cable reels off the reel, winding up the spring on the reel. The spring on the reel then retracts the cable to bring the ball back for a subsequent use.

1 Claim, 3 Drawing Figures

DEVICE FOR LAUNCHING AND RETRIEVING A SPHERICAL BALL

BACKGROUND OF THE INVENTION

Devices which teach tethered balls which return after being struck are well known, and are taught in devices such as are shown in U.S. Pat. Nos. 3,161,409; 3,157,400; 2,942,883; 3,643,948; 3,229,979; and 3,794,323. However, none of these devices teach any structure which will allow a ball to be ejected upwardly in such fashion that it can be hit by a batter for batting practice. Such is the structure taught in the instant device.

SUMMARY OF THE INVENTION

This invention is designed to enable an individual to practice batting. With this invention, a spherical ball is ejected upwardly and can be hit by a batter. The ball is tethered to a housing by a cable, which is wound on a spring-loaded reel. As the ball travels away after being hit, the cable is wound off the reel, which is then rewound by the spring. The ball can then be returned to the housing to be ejected and hit again. The ejection is accomplished by a spring-loaded ejector means that is operated by the user's foot.

DETAILED DESCRIPTION OF PREFERRED EMBODIMENTS

A generally rectangular housing 10 has an open-topped hemispherical recess 20 in its upper surface. A spherical ball 30 can be placed in the recess.

Figure 1:
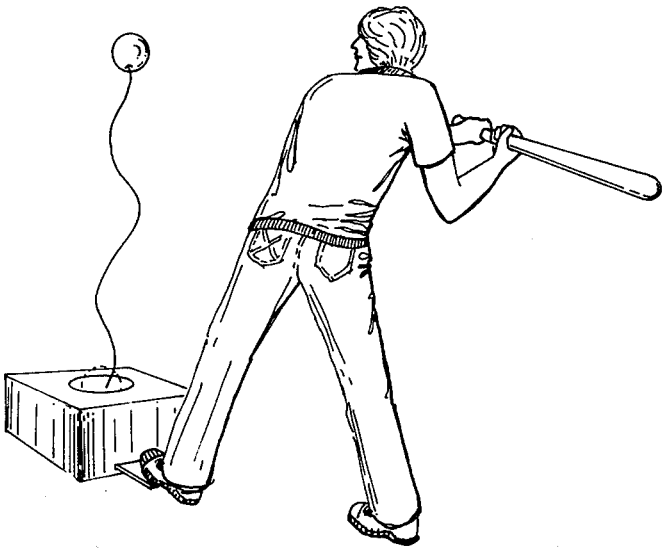
FIG. 1 shows the invention in use.
Figure 2:
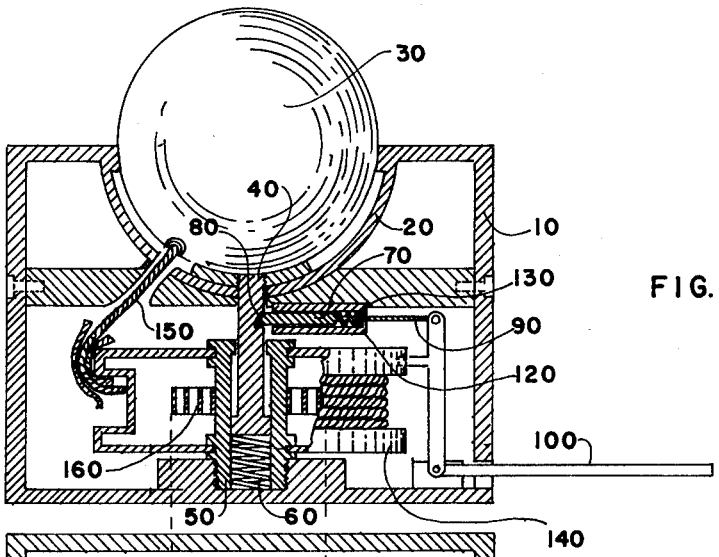
FIG. 2 shows a side cross-sectional view of the invention.
Figure 3:
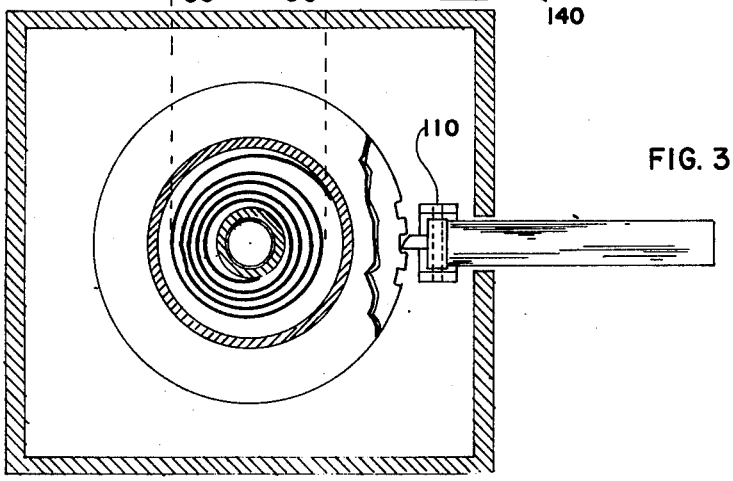
FIG. 3 shows a top view of the invention.

A plunger 40 has a vertical, downwardly extending shaft that has a curved circular plate attached to its tip. The shaft of the plunger extends downwardly into an axial bore of a generally cylindrical post 50. A compression spring 60 located between the bottom of the plunger and the housing pushes the plunger upwardly. In order to retain the plunger in the post when the spring 60 is compressed, an elongated horizontally extending latch 70 engages a corresponding notch 80 in the shaft of the plunger. In order to allow the plunger to be pushed upward by the spring 60, the latch can be moved to the right as viewed in FIG. 2. This motion takes place because arm 90 (which is secured to the latch) is pivotally secured to the top of the shorter side of an L-shaped foot pedal 100. The pedal rocks back and forth on axle 110 that is located at the vertex of the pedal, and the longer side can be depressed by the user's foot to disengage the latch from the plunger. The latch rides back and forth in a channel in member 120, with a compression spring 130 being wrapped around the arm 90 and being located between the end of the channel and the rear end of the latch. Spring 130 insures that the latch is biased forwardly against the plunger, and it can be seen that the front edge of the latch is so shaped that the plunger, once released, can be depressed so as to re-engage the latch.

Around the post rotates a horizontal, hollow reel 140. A flexible cable 150 is attached to the reel at one end and to the ball at the other, and as the reel rotates in a horizontal plane the cable is wrapped around the reel.

A coiled strip of spring steel 160 is located inside the reel and attached to the reel interior at one end and the post at the other. As the ball travels away from the housing, the cable unwraps off the reel as the reel rotates. The spring 160 is then wound up and as the tension of spring 160 increases to a point where the spring unwinds, the reel is eventually rewound to return the ball back to the housing for re-insertion into the recess.

I claim:

1. A device for launching a spherical ball to enable the ball to be hit by a bat and then retrieved after being hit, comprising;

a spherical ball;

a housing with an open-topped hemispherical recess in its top into which the ball may be placed;

foot-operated ejector means for propelling the ball upwardly out of the recess when the ejector means is actuated, the means cooperating with the ball and recess in a manner that once the ball has been replaced in the recess after the means has been operated, the means will be reset for a subsequent operation, said ejector means including a spring-loaded plunger extending upwardly into said recess;

an elongated flexible cable attached at one end to the ball; and a spring-loaded retractor means located in the housing and attached to the end of the cable remote from the ball to retract the ball back into the recess after the ball has been ejected out of the recess and hit by a bat, said retractor means comprising a reel rotatably mounted in the housing, said cable being attached at its other end to the reel and a coiled spring within the reel affixed at one end to a fixed point in the housing within the reel and affixed at its other end to the inside of said reel in a manner whereby as the cable unwinds from the reel the spring winds up and when the cable is unwound the wound spring rotates the reel to rewind said cable by unwinding.

* * * * *